US005154066A

United States Patent [19]

Choi

[11] Patent Number: 5,154,066

[45] Date of Patent: Oct. 13, 1992

[54] COOLING A COMPRESSOR AND CONDENSER OF A REFRIGERATOR

[75] Inventor: Dong-Kgoo Choi, Seoul, Rep. of Korea

[73] Assignee: Samsung Electronics Co., Ltd., Kyonggi, Rep. of Korea

[21] Appl. No.: 697,428

[22] Filed: May 9, 1991

[30] Foreign Application Priority Data

May 16, 1990 [KR] Rep. of Korea ..... 90-7009

[51] Int. Cl.[5] ..... F25D 17/06

[52] U.S. Cl. ..... 62/429; 62/505; 62/507

[58] Field of Search ..... 62/183, 505, 506, 507, 62/428, 429

[56] References Cited

U.S. PATENT DOCUMENTS

| | | | |
|---|---|---|---|
| 1,769,119 | 7/1930 | Davenport | 62/506 |
| 2,350,249 | 5/1944 | Osborn | 62/429 |
| 2,914,927 | 12/1959 | Corhanidis | 62/429 |
| 4,089,187 | 5/1978 | Schumacher et al. | 62/289 |

FOREIGN PATENT DOCUMENTS

| | | |
|---|---|---|
| 991049 | 9/1951 | France . |
| 1027676 | 2/1963 | United Kingdom . |

*Primary Examiner*—Ronald C. Capossela

*Attorney, Agent, or Firm*—Burns, Doane, Swecker & Mathis

[57] ABSTRACT

A refrigerator includes a freezer space, a cold space, a refrigerating system for producing cold air, and a first fan for circulating the cold air through the freezer space and cold space. The refrigerating system includes a condenser and a compressor. The compressor extends within a vertical air conduit at the back of the refrigerator and includes a loop-shaped upper end disposed at an upper air inlet of the conduit. The compressor is disposed adjacent an air outlet of the conduit situated at the lower rear end of the refrigerator. A second fan circulates ambient air through the loop-shaped end and through the conduit to cool the condenser and the compressor. The first and second fans are fixed to oppositely directed output shafts of a common motor.

8 Claims, 3 Drawing Sheets

COOLING A COMPRESSOR AND CONDENSER OF A REFRIGERATOR

BACKGROUND OF THE INVENTION

1. Field of the Invention

The present invention relates to a cooling system for cooling a compressor and a condenser of a refrigerator.

2. Description of the Prior Art

Such refrigerators are disclosed, for example, in U.S. Pat. No. 4,089,187 of Frank A. Schumacher et al and Japanese patent laid-open publication No. sho 55-155170 of Yamazaki et al.

In that U.S patent there is discribed a condenser air flow system of a house-hold refrigerator having a compressor, a water evaporating pan and a fan arranged in a chamber located on the bottom of the refrigerator.

According to such a structure, the compressor is cooled or refrigerated by air received through an air inlet orifice which is formed on the front side of the chamber and then the condenser is cooled by ventilating the air by the fan through an exhaust aperture formed in a rear wall of the refrigertor and an air outlet orifice formed by the rear wall and a panel member.

Meanwhile, in the above-referenced Japanese patent laid-open publication there is described a structure shown in attached FIG. 1 wherein a body of a refrigerator is generally composed of an outer casing 2, a foamed heat-shield material 3 and an inner casing 4. A compressor 5, a condenser 17 and a pan 20 for receiving resultant water from a defrosting step are contained in a chamber 7 at the bottom of the body 1 of the refrigerator. The chamber 7, which has an air suction inlet 16, is formed by the bottom base 15 of the refrigerator body.

More particularly, a cover 10 is arranged which generally covers the entire rear panel 2*a*, the chamber 7, and a roof panel 2*b* of the refrigerator body. A duct 11 is disposed between the cover plate 10 and the panels 2*a* and 2*b*. With this structure, the air is received through the air suction inlet 16 on the bottom base 15 into the chamber 7 and then exchanges heat with the condenser 17 and the compressor 5. Then, the heat-changed air is advanced in the direction of arrows through the duct 11 and then ventilated through the outlet 13 formed on an upper and front area of the refrigerator. In this drawing, numerical reference number 9 is a door for opening and closing a front opening of an inner room or compartment 8 of the refrigerator, the inner room 8 being defined by the inner casing 4.

In the structure as described above, however, since the main condensing component of the whole condenser is provided on the rear panel 2*a* of the refrigeator body, it is impossible to obtain the cooling effect in a naturalistic circulation of ambient air, and since the compressor also is constructed so that it is to be cooled by a naturalistic circulation of ambient air, the cooling effect also is efficiently unobtainable. Accordingly, there have occured problems in that the operational effect of the compressor is reduced and the performance of the refrigerator also is deteriorated when the refrigerating load of the cold room and freezer room are increased because the rising temperature of the rear panel caused by heat-radiating of the condenser installed on the rear panel of the refrigerator body.

OBJECTS AND SUMMARY OF THE PREFERRED EMBODIMENTS OF THE INVENTION

Accordingly, the present invention has been made to avoid the above-mentioned problems of the prior art and it is an object of the present invention to provide a cooling system for cooling a compressor and a condenser of a refrigerator by of the forced circulation of ambient air in which the condenser, attached on the rear wall of the refrigerator body, can be cooled by air drawn-in by an outer fan disposed on a rotating shaft of a drive motor and the compressor can be cooled by the same air used to cool the condenser.

In order to acheive the above object, a cooling system for cooling a condenser and a compressor of a refrigerator according to the present invention preferably comprises dividing means for dividing the interior of the refrigerator into a freezer room and a cold room; and inner fan rotatably disposed on an inner rotating shaft of a drive motor and circulating the airflow cooled by the cooling means within the freezer room and the cold room; and compressing means for supplying a refrigerant to the cooling means. A condensing means has a circle-shaped upper end and a lower end fixed near the bottom of a rear wall of an outer casing. An outer fan is rotatably disposed on an outer rotating shaft of the drive motor; a rear cover forms a conduit whose upper side is circle-shaped and receives the loop-shaped end of the condensing means. A compressing means is disposed near a rear opening formed in the chamber formed on the bottom of the refrigerator. Ambient air is introduced through the circle-shaped opening by driving the outer fan and is then ventilated through the opening of the chamber so that the condensing means and the compressing means are sequentially cooled by the air.

BRIEF DISCRIPTION OF THE DRAWINGS

DESCRIPTION OF THE PREFERRED EMBODIMENT

Hereinafter, a preferred embodiment of the present invention will be described with reference to FIGS. 2 and 3.

Figure 1:
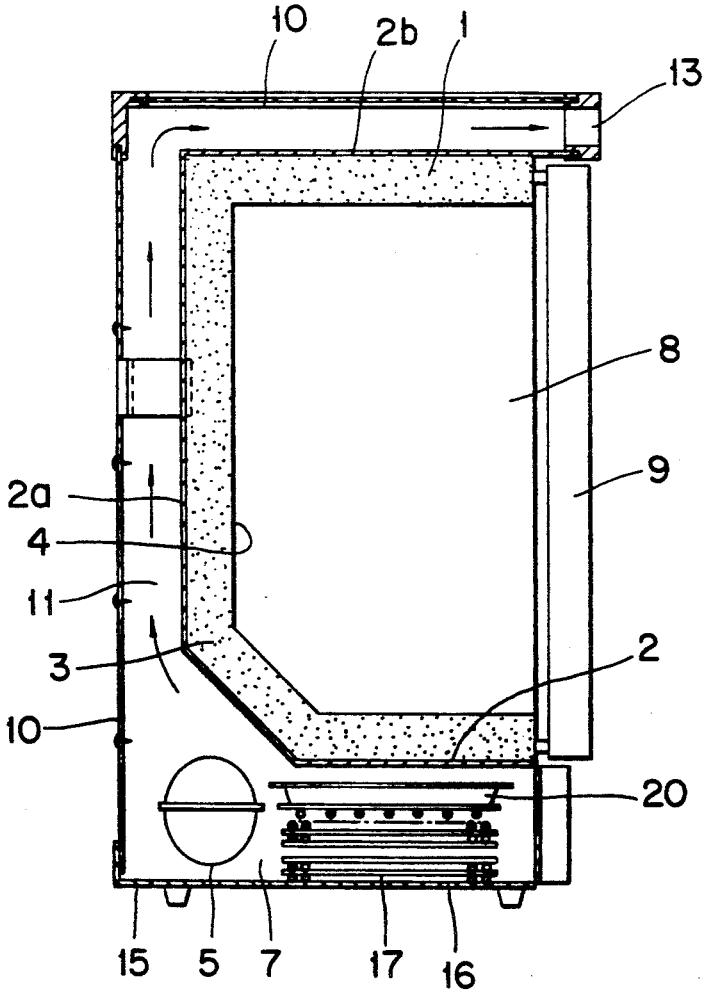
FIG. 1 (PRIOR ART)
FIG. 1 is a vertical sectional view through a conventional refrigerator.
Figure 2:
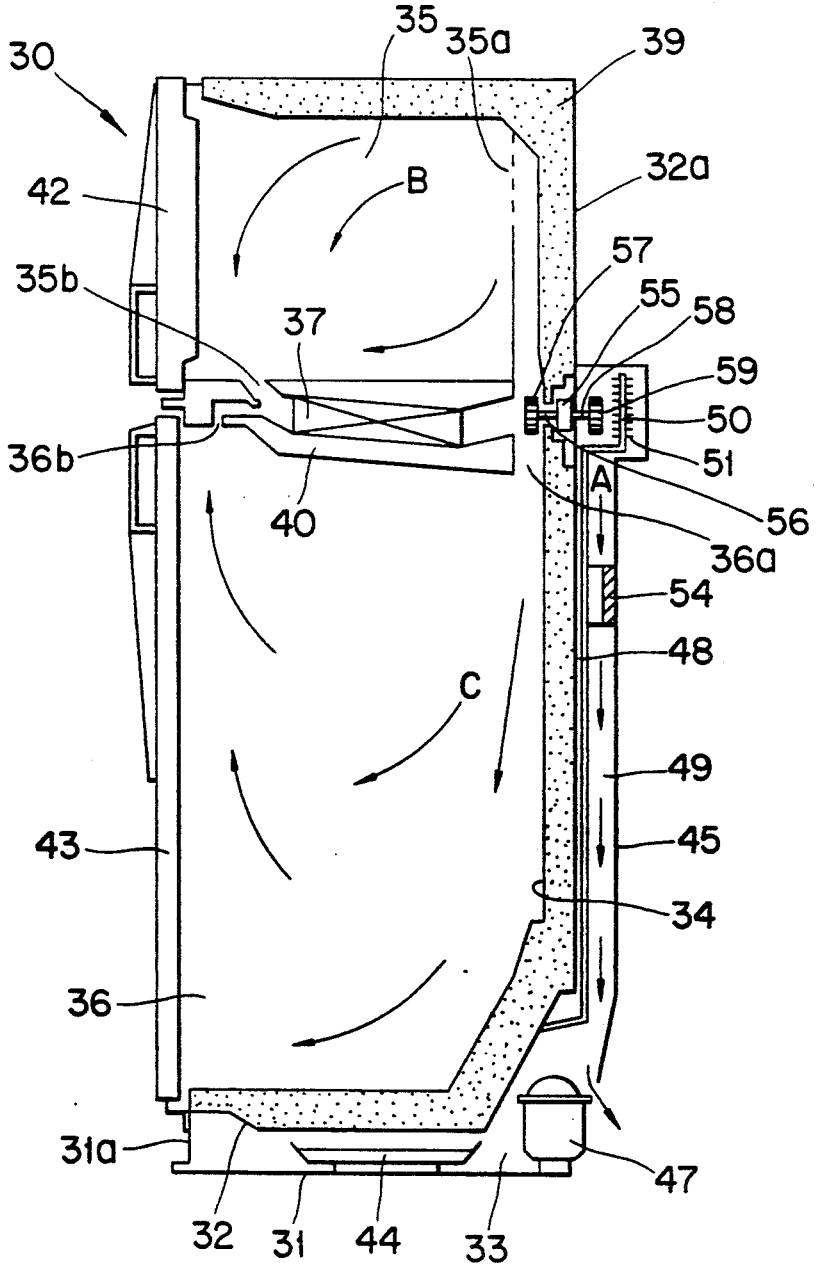
FIG. 2 is a schemtic, vertical sectional view of a refrigerator having a cooling system according to the present invention; and, FIG. 3 is a schematic rear view of FIG. 2.
Figure 3:
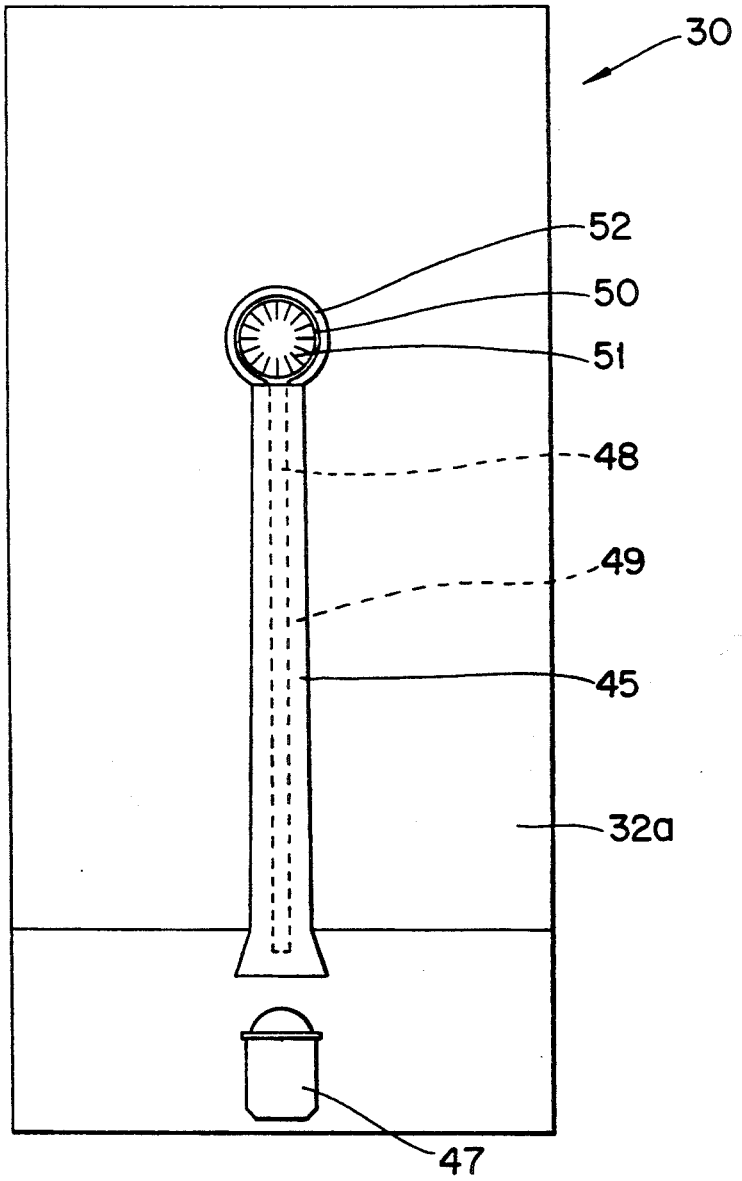

First, as shown in FIGS. 2 and 3, a body of the refrigerator is composed of an outer casing 32, a formed heat-shield material 39 and an inner casing 34, and the interior of the refrigerator is divided into a freezer room or space 35 and a cold space or room 36 by a dividing wall 40. Also, a cooler 37 of a cooling cycle is arranged in the dividing wall 40 and a chamber 33 is disposed on the bottom of the refrigerator body 30 and receives on its bottom a water evaporating pan 28 and the compressor 47. The chamber 33 is opened at its rear side and is closed up tightly at its front side by the front panel 31*a* which is formed integrally by a pressing step with a base plate 31.

Meanwhile, the condenser 48 is disposed in parallel to and on the rear wall 32*a* of the outer casing 32. This condenser 48 has one end provided with a loop-shaped preferably circle-shaped condensing component 50 having a plurality of refrigerating fins 51 and the other end is fixed to the rear wall 32*a*. Also, the rear wall 32*a* is provided with a rear cover 45 which by means of a fixing member 54 is spaced a predetermined distance away from the condenser 48. The rear cover 45 forms an air introducing conduit or duct 49 together with the rear wall 32*a* of the outer casing 32. The air introducing duct 49 is provided at its upper side with a circle-shaped opening 52 for introducing air by driving of an outer fan 59 which will be described below and the bottom of the rear cover 45 is disposed slightly upwardly relative to the upper side of the compressor 47 disposed at the rear side of the chamber 33.

Further, a drive motor 55 is arranged between the inner casing 34 and the outer casing 32, more particularly, between the cooler 37 and the condensing component 50. An inner fan 57 is disposed on the inner rotating shaft 56 of the motor 55, and this fan 57 acts such that most air cooled by the cooler can be circulated through a freezer room inlet 35*a* as shown by an arrow B so as to refrigerate the freezer room 35 and then returned to the cooler 37 through a freezer room outlet 35*b* formed on the dividing wall 40. Some air can be circulated through a cold chamber inlet 36*a* as shown by an arrow C so as to refrigerate the cold room 36 and then returned through a cold room outlet 36*b* formed on the dividing wall 40. Also, the outer rotating shaft 58 of the drive motor 55 is provided with an outer fan 59 which induces outer air to flow in the direction indicated by an arrow A. That air cools the condenser 48 arranged in parallel with the rear wall 32*a* of the outer casing 32 and then passes through a bottom rear opening so as to cool the compressor 47. In other words, the inner and outer rotating shafts 56 and 58 attached to the drive motor 55 are integrally formed with the same axis and the rotating shafts 56 and 58 are rotatably provided with the inner and outer fans 57 and 59 to be simultaneously rotated by the driving force of the drive motor 55.

In the drawing, numerical reference number 42 shows a freezer room door for opening and closing the freezer room 35, and 43 shows a cold room door for opening and closing the cold room 36.

Operation of the refrigeration system for cooling a condenser and a compressor of a refrigerator constructed as described above will be now described.

Firstly, most airflow cooled by the cooler 37 is directed to the freezer room 35 through the freezer room inlet 35*a* by the inner fan 57 rotatably disposed on the inner rotating shaft of the drive motor and circulated in the direction indicated by the arrow B to thereby refrigerate the freezer room 35. After that, the airflow flows through the freeze room outlet 35*b* into the cooler 37 to be cooled by the cooler 37. At that time, some airflow cooled by the cooler 37 is directed to the cold room 36 through the cold room inlet 36*a* by means of the inner fan 57 as described above and circulated in the direction indicated by the arrow C to refrigerate the cold room 36. After that, the airflow flows through the cold room outlet 36*b* into the cooler 37 and the airflow is again cooled by the cooler 37.

Accordingly, the airflow cooled by the cooler 37 is exhausted into the freezer room 35 and the cold room 36 so as to sequentially refrigerate the freezer and cold rooms 35 and 36 by rotating the inner fan 57 rotatably attached to the inner rotating shaft 56 in accordance with driving of the drive motor 55. Since the inner and outer shafts 56 and 58 of the drive motor 55 are integrally formed with the same axis, then by rotating of the outer fan 59 fixed to the outer rotating shaft 58, air is circulated through the circle-shaped opening 52 of the rear cover 45, the condensing component and the cooling fan 51 and passed through the air introducing duct 49 as shown by the arrow A to thereby cool the condenser 48 and the compressor 47 disposed near the rear opening of the chamber 33, and the airflow is eventually ventilated outwardly.

As described above, according to the cooling system for cooling a condenser and a compressor of refrigerators according to the invention, the system is constructed so that the rotating shafts are integral with the drive motor and positioned to the inner and outer sides of the refrigerator. The airflow cooled by the cooler is circulated in the freezer room and the cold room to refrigerate them by driving the inner fan fixed on the inner rotating shaft of the refrigerator. At the same time air is introduced into the upper side of the air introducing duct by the outer fan fixed in the outer rotating shaft to cool the condenser. After that, the airflow is downwardly forced-circulated to cool the compressor arranged in the chamber. Therefore, the structure of the system is very simple and the refrigerating effect is desirably improved because the airflow cooled by the cooler refrigerates the freezer room and the cold room and at that time the condenser and the compressor are cooled by using one motor, whereby the manufacturing cost can be considerably decreased.

Obviously, it is to be understood that the invention is not limited to the precise embodiment described with reference to the accompanying drawings and that various changes and modifications may be effected therein by one skilled in the art without departing from the scope or spirit of the invention.

What is claimed is:

1. A refrigerator comprising at least one food storage space; refrigerating means for producing cold air, including a compressor and a condenser; first circulating means for circulating said cool air through said food storage space; second circulating means for circulating ambient cooling air across said condenser and compressor; a common motor driving said first and second circulating means; a vertically extending cover space rearwardly from a rear wall of said refrigerator for forming an ambient air conduit extending downwardly along said rear wall; said ambient air conduit having an air inlet located at an upper end thereof, and an air outlet located at a lower rear end of said refrigerator; said condenser extending vertically within said ambient air conduit; said compressor disposed at a bottom of said refrigerator closely adjacent said air outlet for communicating with said ambient air conduit; said second circulating means being disposed adjacent said ambient air inlet for circulating a stream of ambient cooling air downwardly through said ambient air conduit and into cooling contact with said condenser and said compressor; said condenser including a loop-shaped upper end having cooling fins; said second circulating means being disposed downstream of said loop-shaped upper end with reference to the direction of flow of said air stream to draw-in air through said loop-shaped end.

2. A refrigerator according to claim 1, wherein a horizontal width of said air conduit is substantially less than a horizontal width of said rear wall of said refrigerator.

3. A refrigerator according to claim 1, wherein said second circulating means comprises a fan rotating about an axis which passes centrally through a loop formed by said loop-shaped upper end of said condenser.

4. A refrigerator according to claim 3, wherein said loop is of circular shape.

5. A refrigerator comprising a food storage area including a freezer space and a cold space disposed one above the other and separated by a divider wall; refrigerating means for producing cold air, including a compressor and a condenser; a first fan for circulating said cold air through said food storage area; an ambient air conduit extending downwardly along a rear wall of said refrigerator, said ambient air conduit having an ambient air inlet disposed at an upper end thereof, and an air outlet disposed at a lower rear end of said refrigerator; said condenser extending vertically within said ambient air conduit and including a loop-shaped upper end disposed adjacent said ambient air inlet; said compressor being disposed at a bottom of said refrigerator closely adjacent said air outlet for communicating with said ambient air conduit; and a second fan for drawing a stream of ambient cooling air into said ambient air inlet and circulating the ambient cooling air downwardly through said ambient air conduit to cool said condenser and said compressor; a motor disposed at about the same elevation as said divider wall and having first and second oppositely directly coaxial output shafts; said first and second fans being fixed to said first and second output shafts, respectively, an axis of rotation of said second output shaft passing through a loop formed by said loop-shaped upper end so that said second fan induces said ambient air stream to pass through said loop.

6. A refrigerator according to claim 5, wherein a horizontal width of said air conduit is substantially less than a horizontal width of said rear wall of said refrigerator.

7. A refrigerator according to claim 5, wherein said loop is of circular shape.

8. A refrigerator according to claim 5, wherein said second fan is disposed downstream of said loop with reference to the direction of flow of said ambient air stream.

* * * * *